United States Patent [19]

Holden et al.

[11] 4,327,474

[45] May 4, 1982

[54] METHOD OF MAKING PEDESTAL LINER FOR A RAILWAY VEHICLE

[75] Inventors: Homer N. Holden, Sylva; Reese Sumrall, Maggie Valley, both of N.C.

[73] Assignee: Dayco Corporation, Dayton, Ohio

[21] Appl. No.: 174,087

[22] Filed: Jul. 31, 1980

Related U.S. Application Data

[62] Division of Ser. No. 30,035, Apr. 13, 1979, Pat. No. 4,237,793.

[51] Int. Cl.[3] ..... B51D 53/10; B23P 3/00; B23P 19/04; B21D 35/00

[52] U.S. Cl. ..... 29/149.5 NM; 29/460; 29/469.5; 156/222; 156/338; 264/251

[58] Field of Search ..... 29/469.5, 460, 149.5 NM, 29/149.5 R; 105/225, 199 C; 308/3 R; 156/221, 222, 226, 338; 264/251

[56] References Cited

U.S. PATENT DOCUMENTS

| | | | |
|---|---|---|---|
| 2,293,184 | 8/1942 | Weissert | 156/338 X |
| 2,366,895 | 1/1945 | Griffith | 156/338 X |
| 2,446,516 | 8/1948 | Bailey | 156/222 X |
| 2,675,276 | 4/1954 | Daugherty | 29/149.5 NM X |
| 3,554,618 | 1/1971 | Ditzler et al. | 308/3 R |
| 3,733,668 | 5/1973 | Lange et al. | 29/149.5 NM |
| 3,960,639 | 6/1976 | Kudo | 156/222 |
| 4,001,124 | 1/1977 | Hussey | 105/225 X |
| 4,188,888 | 2/1980 | Cooper et al. | 105/199 C X |
| 4,238,039 | 12/1980 | Cooper et al. | 105/225 X |
| 4,264,015 | 4/1981 | Mathieu | 105/225 X |

FOREIGN PATENT DOCUMENTS

| | | | |
|---|---|---|---|
| 707729 | 4/1954 | United Kingdom | 105/225 |

*Primary Examiner*—Charlie T. Moon
*Attorney, Agent, or Firm*—Joseph V. Tassone

[57] ABSTRACT

A pedestal liner for a pedestal truck of a railway vehicle and method of making same are provided wherein such pedestal liner is of roughly U-shaped configuration having a bight and a pair of parallel legs and comprising a continuous uninterrupted backing material defining the bight and parallel legs, antifriction material for the bight adapted to engage a vertically disposed planar guide surface of an associated journal box, antifriction material for the parallel legs adapted to engage vertically disposed parallel side surfaces of the journal box and disposed on opposite sides of the guide surface, and means fixing the antifriction material against the backing material with the backing material providing optimum structural support for the antifriction material.

9 Claims, 8 Drawing Figures

METHOD OF MAKING PEDESTAL LINER FOR A RAILWAY VEHICLE

This is a division of application Ser. No. 30,035, filed Apr. 13, 1979, now U.S. Pat. No. 4,237,793 issued Dec. 9, 1980.

BACKGROUND OF THE INVENTION

1. Field of the Invention

This invention relates to railway vehicles and in particular to pedestal liners for pedestal trucks of such vehicles.

2. Prior Art Statement

It is known in the art to provide a wear member supported by at least one of a pair of relatively movable components of a railway vehicle for the purpose of protecting the components from wear. However, heretofore it has been common practice to provide a wear member made either entirely of a hard metal or entirely of a hard polymeric material and such wear member is suitably supported in position between such components and once the wear member becomes excessively worn it is removed and a new one installed in its position. However, metal wear members are usually made of comparatively expensive metallic materials and do not have optimum antifriction properties while wear members made entirely of polymeric material have comparatively poor structural strength and thus are often easily broken requiring frequent replacement.

It has also been proposed heretofore to provide so-called wear members or liners for center plate structure of a railway vehicle with reinforcing material embedded therein as disclosed in U.S. patent application Ser. No. 841,175, filed Oct. 11, 1977 U.S. Pat. No. 4,188,888; however, such liners have minimum structural strength and in use are confined between associated supporting surfaces.

Further, it has been proposed in U.S. Pat. No. 3,554,618 to provide a U-shaped pedestal liner consisting of a bight and a pair of parallel legs which has an inserted nylon wear plate for the bight which is unsupported in the central portion of the bight and which is free of antifriction material on the outside surfaces of the parallel legs where substantial wear may also occur in a pedestal liner.

It has also been proposed in U.S. Pat. No. 4,238,039 to provide a wear member comprising a support having a continuous planar supporting surface, a polymeric antifriction wear material, and means attaching the polymeric material to the support and supporting same against the continuous supporting surface for the purpose of providing a substantially structurally self supporting wear member; however, basically in such a member the teaching is to the use of a supported flat planar polymeric antifriction material in a single plane.

SUMMARY

It is a feature of this invention to provide a pedestal liner for a railway vehicle wherein such vehicle comprises pedestal trucks comprising pairs of pedestal legs and a journal box disposed between each pair of pedestal legs with each journal box having a vertically disposed planar central guide surface and a pair of spaced vertically disposed parallel side surfaces disposed on opposite sides of the guide surface and wherein the pedestal liner is roughly U-shaped having a bight and a pair of parallel legs and is for disposal between an associated pedestal leg and journal box and such pedestal liner has a continuous uninterrupted backing material defining its bight and parallel legs, anti-friction material for the bight adapted to engage the guide surface, anti-friction material for the parallel legs adapted to engage the side surfaces, and means fixing the antifriction material against the backing material with the backing material providing optimum structural support for the anti-friction material.

Another feature of this invention is to provide a pedestal liner of the character mentioned in which the backing material is a metal backing material.

Another feature of this invention is to provide a pedestal liner of the character mentioned in which the anti-friction material is defined in three separate parts consisting of one part for each of the legs and bight.

Another feature of this invention is to provide a pedestal liner of the character mentioned in which the anti-friction material for the bight and each of the legs is part of a single-piece structure.

Another feature of this invention is to provide a pedestal liner of the character mentioned having means for fastening such pedestal liner in position wherein such fastening means comprises inserts bonded to and held in position by antifriction material comprising the parallel legs of such liner and the inserts when engaged by associated fasteners prevent cold flow of antifriction material upon fastening the pedestal liner in position.

Another feature of this invention is to provide a pedestal liner of the character mentioned in which the anti-friction material comprises an ultra high molecular weight polymeric material.

Another feature of this invention is to provide a pedestal liner of the character mentioned in which the ultra high molecular weight antifriction material is polyethylene having a molecular weight of at least two million.

Another feature of this invention is to provide an improved method of making a pedestal liner of the character mentioned.

Therefore, it is an object of this invention to provide an improved pedestal liner and method of making same having one or more of the novel features set forth above or hereinafter shown or described.

Other details, features, uses, objects, and advantages of this invention will become apparent from the embodiments thereof presented in the following specification, claims, and drawings.

BRIEF DESCRIPTION OF THE DRAWINGS

The accompanying drawings show present preferred embodiments of this invention, in which.

DESCRIPTION OF ILLUSTRATED EMBODIMENTS

Figure 1:
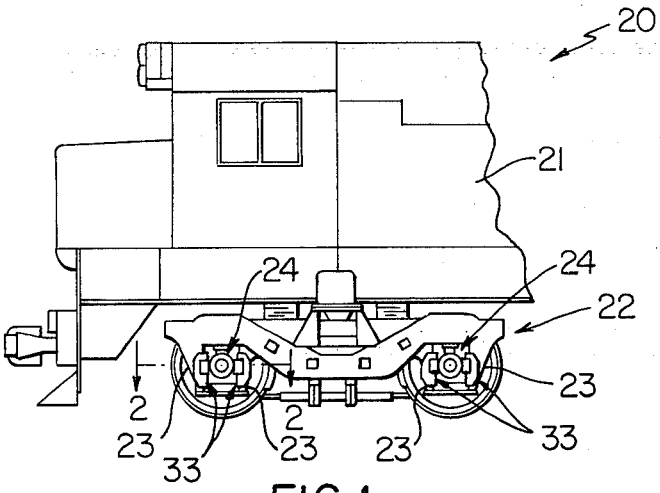
FIG. 1 is a fragmentary side view of a railway locomotive comprising pedestal trucks having pairs of pedestal legs and a journal box disposed between each pair of pedestal legs and which utilizes a pedestal liner of this invention between each associated pedestal leg and journal box.

Reference is now made to FIG. 1 of the drawings which illustrates an exemplary railway vehicle in the form of a railway locomotive which is designated generally by the reference numeral 20. The railway locomotive comprises the usual locomotive main body 21 supported at opposite ends thereof by four-wheel trucks, only one of which is shown in the drawings and designated generally by the reference numeral 22. Each truck 22 is a so-called pedestal truck which is well known in the art and thus will not be discussed herein in detail. Each truck 22 comprises four pairs of pedestal legs with two of such pairs being illustrated in FIG. 1 and each leg of each pair of legs is designated by the reference numeral 23. A journal box 24 is disposed between each pair of pedestal legs 23 as is known in the art.

Figure 2:
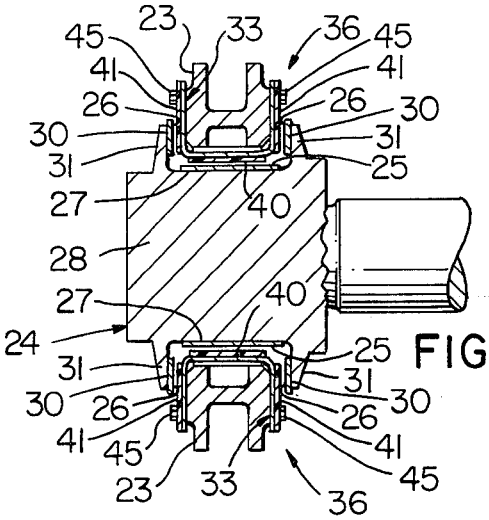
FIG. 2 is a fragmentary cross-sectional view taken essentially on the line 2—2 of FIG. 1 particularly illustrating a pair of pedestal liners of this invention disposed in position between an associated journal box and an associated pair of pedestal legs.

As best seen in FIG. 2 of the drawings each journal box 24 has a vertically disposed central planar guide surface 25 on each side thereof and a pair of spaced vertically disposed parallel side surfaces each designated by the same reference numeral 26 disposed on opposite sides of each central guide surface 25. Each central guide surface 25 in this example of the invention defines the outside surface of a member 27 which may be in the form of a wear plate which is suitably fixed to the main body 28 of the journal box 24. The side surfaces 26 of the journal box 24 comprise plate members 30 which are suitably fixed to integral flanges 31 defined as extensions of the main body 28 of the journal box 24.

Figure 3:
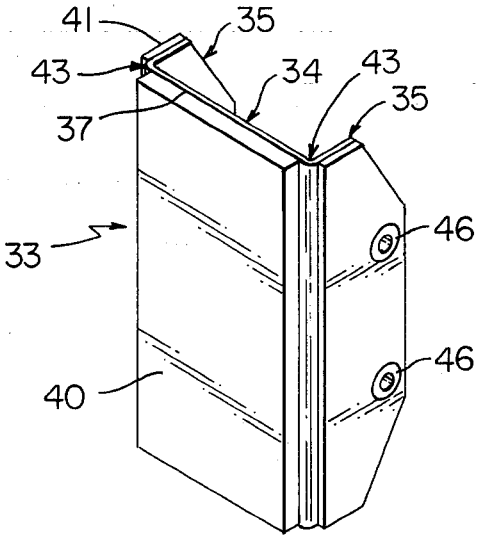
FIG. 3 is a perspective view illustrating a typical pedestal liner of this invention utilized in the pedestal trucks of FIG. 1.

Each pedestal liner is designated generally by the reference numeral 33 and a typical completed pedestal liner is illustrated in perspective view in FIG. 3. Each pedestal liner 33 is roughly U-shaped having a bight designated generally by the reference numeral 34 and a pair of legs each designated by the same reference numeral 35; and, the U-shaped pedestal liner 33 is particularly adapted for disposal between an associated pedestal leg 23 and the journal box 24 and as shown at two typical locations 36 in FIG. 2.

Figure 4:
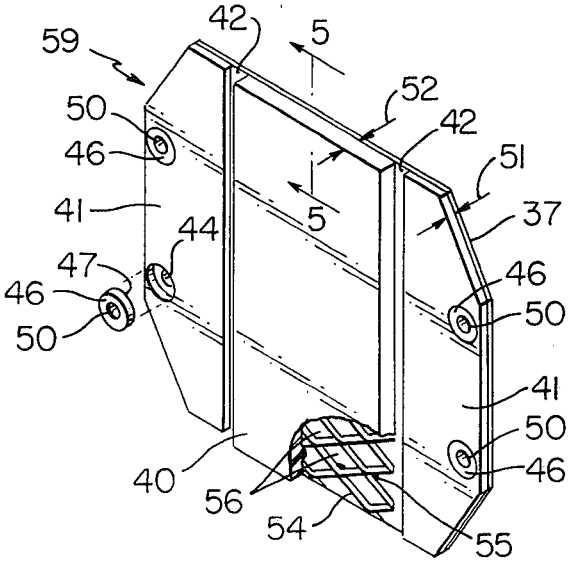
FIG. 4 is a perspective view with a portion broken away illustrating a flat assembly or work piece which is utilized in making the pedestal liner of FIG. 3.

Referring now to FIGS. 3 and 4, it is seen that the pedestal liner 33 comprises a continuous uninterrupted backing material which in this example is shown as a continuous metal sheet 37. The pedestal liner 33 also has antifriction material 40 for the bight 34 thereof and such antifriction material is adapted to engage an associated guide surface 25. The pedestal liner 33 also has antifriction material 41 for the parallel legs 35 and the antifriction material 41 is adapted to engage the side surfaces 26 provided on wear plates 30 which are in turn fixed to the flanges 31 of the journal box 24.

The antifriction materials 40 and 41 are fixed to the backing material 37 utilizing any suitable means or technique known in the art and such means will be described in more detail subsequently. However, it will be appreciated that the continuous uninterrupted metal backing material 37 is defined from a suitable metallic material which has rigidity and comparatively high strength whereby such backing material provides optimum structural support for the antifriction material and in particular for the antifriction material 40 fixed to the bight 34 and antifriction material 41 fixed to the legs 35.

Figure 5:
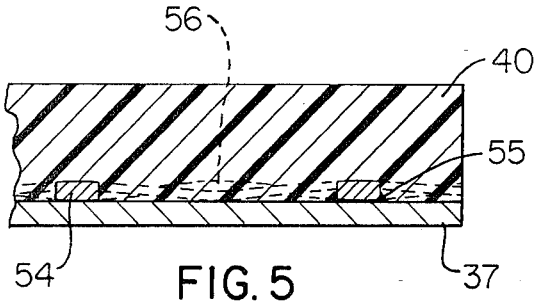
FIG. 5 is a fragmentary cross-sectional view taken essentially on the line 5—5 of FIG. 4.

As will be readily apparent from FIGS. 4–5 of the drawings it will be seen that the antifriction material 40 and 41 is defined in three separate parts consisting of one part of material 41 for each of the legs 35 and one part of antifriction material 40 for the bight 34. With this arrangement of the antifriction material 40 and 41 in three separate parts, two rectangular strips 42 of backing material 37 are exposed and such exposed strips are suitably formed each on a generous radius, shown at 43 in FIG. 3, to define an integral smooth interconnection between the bight 34 and an associated parallel leg 35.

Each pedestal liner 33 has means for fastening such liner to its pedestal leg 23. Such fastening means comprises at least one pair of aligned bores in the legs 35 and in this example two pairs of such aligned bores are illustrated (FIGS. 3 and 4) and each bore of each pair of bores is designated by the same reference numeral 44. Each bore 44 is particularly adapted to receive an associated fastener or fastening bolt 45 therethrough for fastening the associated pedestal liner to a pedestal leg 23. The fastening means for each pedestal liner 33 also comprises a rigid tubular insert designated generally by the reference numeral 46 which is disposed around each of the bores 44 and each of the inserts 46 has an inner end 47 which engages the backing material 37 of its leg 35 and each insert 46 is held (bonded) in position by the antifriction material 41 of its associated leg 35.

Each insert 46 is particularly adapted to prevent high pressure from being exerted on the polymeric material surrounding its bore by an associated fastener 45 to thereby prevent cold flow of antifriction material from around the area of its associated bore 44 upon employing a fastener to fasten the legs 35 to the pedestal legs 23. Each insert is preferably made of a high strength material such as a metal and has a cylindrical bore 50 therethrough of the same diameter as the bore 44 in the metal backing material 37 that it surrounds.

The antifriction material 41 for the legs 35 of pedestal liner 33 is of the same thickness as indicated at 51 and such thickness is different from the thickness 52 of the antifriction material 40 comprising the bight 34. Preferably the thickness 52 is substantially greater than the thickness 51.

The antifriction material 40 and 41 is the same antifriction material in the form of an ultra high molecular weight polymeric material. Preferably such ultra high molecular weight polymeric material is polyethylene having a molecular weight of at least two million. The preferred molecular weight is between four and six million.

As previously mentioned the pedestal liner 33 has suitable means fixing the antifriction material 41 and 40 to the substrate or backing material 37. As is known in the art, it is generally very difficult to bond or fasten polyethylene, or the like, to a metallic material. Accordingly, to achieve this bonding action, the fixing means comprises a metal structure 54 which is fixed to the backing material 37 by any suitable means such as spot welds 55 and the metal structure has openings 56 therein. For simplicity in this example, metal structure 54 is shown used on the bight 34 to fasten the polymeric material 40 in position; however, it is to be understood that such metal structure is also used on each leg 35 to fasten the associated polymeric material 41 in position.

The polymeric material 40 and 41 as the case may be surrounds its metal structure 54 and serves as a matrix therefor while extending through the openings 56. The metal structure 54 is a grid-like structure preferably in the form of an expanded metal structure and the detailed technique for fastening the expanded metal structure to metal substrate is also disclosed in U.S. Pat. No. 4,238,039 which is mentioned in the Background of the Invention and the disclosure of such application is disclosed herein by reference thereto. Thus, with the metal structure 54 fixed to support 37 the provision of the polymeric matrix material 40 and 41 therearound results in such polymeric material being firmly attached to the metal structure and thus firmly attached to the support 37.

The pedestal liner 33 is preferably made by fixing polymeric material 40 and 41 on a flat sheet of material 37 having the outline shown in FIG. 4 and the bore 44. Three sections of metal structure 54 are then spot welded in position and the entire subassembly placed in a special die structure or mold device for introduction of polymeric material to define the polymeric portions 40 and 41. The inserts 46 are then suitably supported in position. The polymeric material may be provided in powder, flake, or pellet form and is heated under controlled temperatures and pressures in the mold device to define a molten state for such polymeric material. In the case of ultra high molecular weight polyethylene having a molecular weight in the range of four to six million such material may be formed or molded at temperatures ranging between 250° and 450° F., at pressures ranging between 500 to 2,000 psi, and with the molding action being achieved within time periods of three minutes to thirty minutes.

After the molding action is achieved the mold device and flat assembly or workpiece 59 of FIG. 4 are cooled. The workpiece 59 is then suitably bent or formed into the U-shape shown in FIG. 3 with generous radii 43 formed in the rectangular portions 42 of the backing material. It will also be appreciated that molten polymeric material defining portions 40 and 41 may be provided from a suitable extruder or like device into the mold device instead of processing dry polymeric material.

The polymeric antifriction material 40 and 41 comprising the bight 34 and legs 35 respectively is the same polymeric material and is bonded in position simultaneously with the forming thereof to define the workpiece 59. The mold device is made as is known in the art to define the shapes of portions 40 and 41 while defining rectangular voids on opposite sides of portion 40 which expose the substrate 37 and define the previously mentioned rectangular cutouts.

Figure 6:
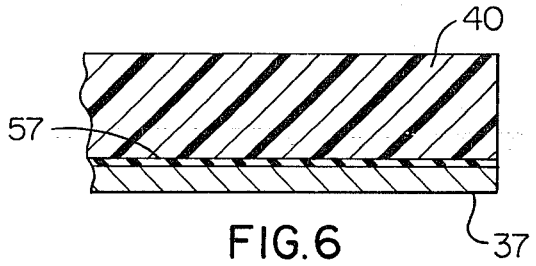
FIG. 6 is a view similar to FIG. 5 illustrating a modified technique for fixing antifriction material on the backing material comprising the pedestal liner of FIG. 3.

In the above description the pedestal liner has been made using mechanical means in the form of a metal grid-like structure 54 which is welded or otherwise fixed to the backing member 37 and the polymeric material formed therearound to bond the antifriction material 40 and 41 to the substrate 37. However, it will be appreciated that a metal grid-like structure 54 need not necessarily be employed and instead of employing such metal structure it may be preferred to bond a rubber intermediate layer 57 in sandwiched relation, as shown in FIG. 6, between each portion 40 and 41 and the metal substrate 37. The rubber layer 57 is provided in three parts so that each corresponds in outline to its portion 40 or 41 of polymeric antifriction material. With this technique an assembly or flat workpiece substantially identical to the workpiece of FIG. 4 is provided with the exception that rubber layer portions 57 are utilized to fix or fasten each polymeric portion 40 and 41 to the substrate 37 instead of the expanded metal structure 54.

The bonding of portions 40 and 41 to substrate 37 employing the rubber layer 57, which is in three portions, is preferably achieved in a simultaneous manner with the actual forming of the polymeric material in position to define portions 40 and 41. Further, the three portions of rubber 57 are uncured sheets or portions of rubber. Thus, the heat, pressure, and time increment used in the molding action results in bonding the rubber 57 to the substrate and polymeric material 40–41 while simultaneously curing the rubber 57 whereby a tenacious bond is provided between rubber 57, substrate 37, and polymeric material 40–41.

Figure 8:
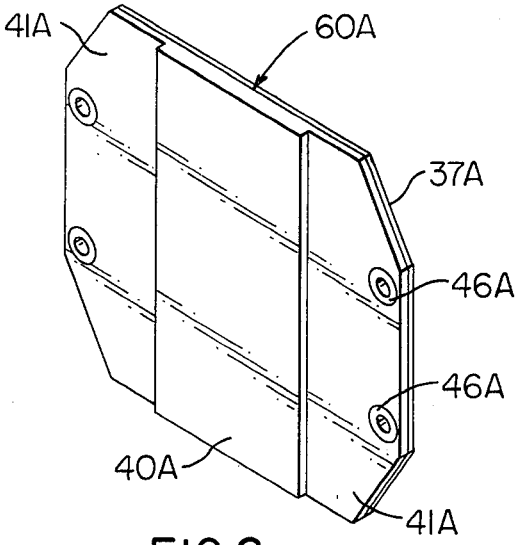
FIG. 8 is a view similar to FIG. 4 illustrating a flat assembly or workpiece which may be employed in making the pedestal liner of FIG. 7.
Figure 7:
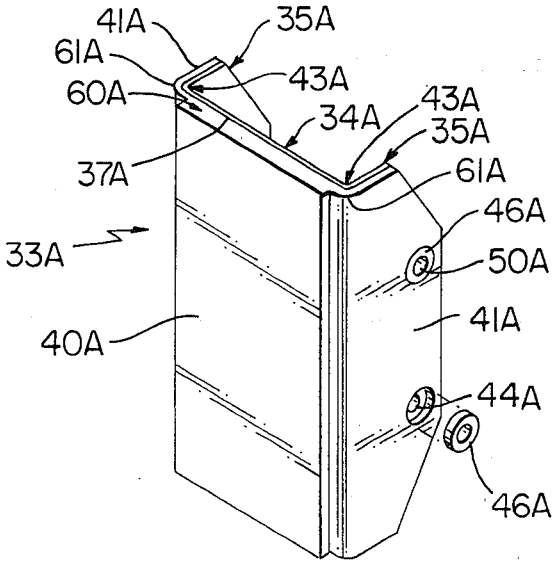
FIG. 7 is a view similar to FIG. 3 illustrating another exemplary embodiment of the pedestal liner of this invention which may be used interchangeably with the pedestal liner of FIG. 3.

Another exemplary embodiment of the pedestal liner of this invention is illustrated in FIGS. 7 and 8 of the drawings. The pedestal liner of FIGS. 7–8 is very similar to the pedestal liner 33; therefore, such pedestal liner will be designated by the reference numeral 33A and representative parts of such pedestal liner which is similar to corresponding parts of the pedestal liner 33 will be designated in the drawings by the same reference numeral as in the pedestal liner 33 (whether or not such representative parts are mentioned in the specification) followed by the letter designation A. Only those component parts of the pedestal liner 33A which are different from corresponding parts of the pedestal liner 33 will be designated by new reference numerals each also followed by the letter designation A.

The pedestal liner 33A is also of generally U-shaped configuration consisting of a bight 34A and a pair of legs 35A and such pedestal liner also comprises a backing material 37A. In addition, the pedestal liner 33A has fastening means including aligned bores 44A identical to the bores 44 previously described and it will be seen that metal inserts 46A are also provided and held in position by polymeric material.

The main difference between the pedestal liner 33A and the pedestal liner 33 is that the pedestal liner 33A has antifriction material for its bight 34A and each of the legs 35A as a single-piece structure which is designated generally by the reference numeral 60A in FIG. 8. The single-piece structure 60A may be suitably bonded in position employing expanded metal similar to the expanded metal 54 or by any other suitable technique including a rubber bonding layer (single-piece) similar to the bonding layer 57 illustrated in FIG. 6. The bonding action may be achieved employing a mold device and at temperatures, pressures, and times as previously described in connection with the pedestal liner 33.

However, regardless of how defined it will be seen that the single-piece layer of antifriction material has a central portion 40A comprising bight 34A of liner 33A which is substantially thicker than the antifriction material 41A of the legs 35A. As in the case of portion 40 of liner 33, portion 40A is roughly several times the thickness of portion 41A.

The antifriction material 60A is defined as a single-piece whereby it is free of rectangular cutouts. Upon bending the substantially flat workpiece of FIG. 8 to define the U-shaped pedestal liner 33A arcuate portions 61A are defined in the polymeric material 60A which overlie the arcuate portions 43A of the backing material 37A.

Each pedestal liner 33 and 33A is made by bonding antifriction material either as a single-piece or in three separate parts to a flat substrate or metal sheet to define a flat workpiece or assembly as illustrated in each of FIGS. 4 and 8. Each flat workpiece is then suitably formed utilizing mechanical forming techniques which are well known in the art to define in the case of the workpiece of FIG. 4 the pedestal liner 33 and in the case of the workpiece of FIG. 8 the pedestal liner 33A.

Reference has been made to the use of ultra high molecular weight material such as polyethylene to define the antifriction material portions of liners 33 and 33A. It is to be understood that the preferred technique for determining this molecular weight is referred to as the intrinsic viscosity test and is widely used in the United States.

While present exemplary embodiments of this invention, and methods of practicing the same, have been illustrated and described, it will be recognized that this invention may be otherwise variously embodied and practiced within the scope of the following claims.

What is claimed is:

1. In a method of making a U-shaped pedestal liner for a railway vehicle comprising forming a bight and a pair of parallel legs extending from opposite ends of said bight wherein said parallel legs consist of a single thickness of material the improvement comprising making said legs and bight of a plurality of thicknesses comprising the steps of, providing a planar continuous uninterrupted sheet of metal backing which is adapted material to define said bight and parallel legs, fixing antifriction material to a central portion of said backing material to define said bight, fixing antifriction material on each side of said central portion of said planar sheet of backing material adapted to define said parallel legs, said backing material providing optimum structural support for said antifriction material and then bending the planar sheet of backing material with the antifriction material fixed thereto to define said U-shaped pedestal liner having said bight and parallel legs, said antifriction material defining the surface of said U-shaped liner.

2. A method as set forth in claim 1 wherein each of said fixing steps comprises fixing metal structure having openings therein to the bight and parallel leg portions of said backing material and forming said antifriction material in surrounding relation around said metal structure to define a matrix for the metal structure with said antifriction material extending through the openings and against said backing material to thereby fix the antifriction material to the backing material.

3. A method as set forth in claim 2 in which each of said fixing steps comprises welding said metal structure against said backing material.

4. A method as set forth in claim 2 in which each of said fixing steps comprises fixing antifriction material consisting of an ultra high molecular weight polymeric material by forming said polymeric material in position in a mold device employing solid particles of the polymeric material.

5. A method as set forth in claim 1 in which each of said fixing steps comprises fixing said antifriction material against said backing material employing an intermediate bonding layer made of rubber.

6. A method as set forth in claim 1 in which each of said fixing steps comprises disposing a bonding layer made of uncured rubber between the backing material and antifriction material consisting of polymeric material, and forming the polymeric material in position in an associated mold device employing solid particles of polymeric material to thereby form the antifriction material and simultaneously bond and cure the rubber layer in position.

7. A method as set forth in claim 1 in which said step of fixing said antifriction material against said planar sheet of backing material comprises fixing a continuous single piece of antifriction material against the backing material prior to bending thereof to define said U-shaped liner.

8. A method as set forth in claim 1 in which said step of fixing said antifriction material against said planar sheet of backing material comprises fixing said antifriction material in three separate parts, said three parts upon bending said backing material to define said U-shaped liner defining the bight and parallel legs thereof.

9. A method as set forth in claim 1 in which said steps of fixing antifriction material comprises fixing polyethylene having a molecular weight ranging between four and six million.

* * * * *